US010139203B1

(12) United States Patent
Teal

(10) Patent No.: US 10,139,203 B1
(45) Date of Patent: Nov. 27, 2018

(54) REMOTELY RESETTABLE TARGET SYSTEM

(71) Applicant: Sonny Lynn Teal, New London, NC (US)

(72) Inventor: Sonny Lynn Teal, New London, NC (US)

( * ) Notice: Subject to any disclaimer, the term of this patent is extended or adjusted under 35 U.S.C. 154(b) by 0 days.

(21) Appl. No.: 15/970,341

(22) Filed: May 3, 2018

(51) Int. Cl.
*F41J 7/04* (2006.01)
*F41J 1/10* (2006.01)
*A63F 9/02* (2006.01)

(52) U.S. Cl.
CPC . *F41J 7/04* (2013.01); *F41J 1/10* (2013.01); *A63F 9/0204* (2013.01)

(58) Field of Classification Search
CPC ..... F41J 1/10; F41J 7/04
USPC ..... 273/390–392
See application file for complete search history.

(56) References Cited

U.S. PATENT DOCUMENTS 3,844,559 A * 10/1974 Davidson ..... F41J 7/04 273/127 D
4,550,918 A * 11/1985 Motsenbocker ..... F41J 7/04 273/385
4,949,980 A * 8/1990 Hoy ..... F41J 7/04 273/391
5,263,722 A * 11/1993 Rosellen ..... F41J 7/04 273/391
5,324,043 A * 6/1994 Estrella ..... F41J 7/04 273/391
5,340,116 A * 8/1994 Reinart ..... F41J 7/04 273/391
5,342,062 A * 8/1994 Lance ..... F41J 1/10 273/391
6,896,267 B1 * 5/2005 Le Anna ..... F41J 7/04 273/391
7,422,216 B1 * 9/2008 Underhill ..... F41J 7/04 273/392
10,001,349 B2 * 6/2018 Cote ..... F41J 1/10
2002/0030323 A1 * 3/2002 Slifko ..... F41J 7/04 273/391
2004/0195775 A1 * 10/2004 Goldsmith, Jr. ..... F41J 7/04 273/392
2010/0032905 A1 * 2/2010 Morrow ..... F41J 1/10 273/366

* cited by examiner

*Primary Examiner* — Mark Graham

(57) ABSTRACT

The remotely resettable target system is a set of practice targets for use when shooting a firearm. One or more non-resetting targets and a resetting target start in a vertical position where they are visible from uprange. When struck by a fired round, the one or more non-resetting targets 300 pivot to a horizontal position and disappear from sight. When struck by a fired round, the resetting target pivots to a non-vertical position and then returns to the vertical position. While in the non-vertical position, the resetting target releases the one or more non-resetting targets, causing the one or more non-resetting targets to pivot back to the vertical position.

18 Claims, 6 Drawing Sheets

REMOTELY RESETTABLE TARGET SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of shooting sports, more specifically, a remotely resettable target system.

SUMMARY OF INVENTION

The remotely resettable target system is a set of practice targets for use when shooting a firearm. One or more non-resetting targets and a resetting target start in a vertical position where they are visible from uprange. When struck by a fired round, the one or more non-resetting targets pivot to a horizontal position and disappear from sight. When struck by a fired round, the resetting target pivots to a non-vertical position and then returns to the vertical position. While in the non-vertical position, the resetting target releases the one or more non-resetting targets, causing the one or more non-resetting targets to pivot back to the vertical position.

An object of the invention is to provide a set pf practice targets for use when shooting a firearm.

Another object of the invention is to provide a plurality of non-resetting targets that pivot to a horizontal position and latch when struck by a fired round.

A further object of the invention is to provide a resetting target that pivots to a non-vertical position, releases the non-resetting targets, and returns to a vertical position when struck by a fired round.

Yet another object of the invention is to provide a resetting target that is visually distinguishable from the non-resetting targets.

These together with additional objects, features and advantages of the remotely resettable target system will be readily apparent to those of ordinary skill in the art upon reading the following detailed description of the presently preferred, but nonetheless illustrative, embodiments when taken in conjunction with the accompanying drawings.

In this respect, before explaining the current embodiments of the remotely resettable target system in detail, it is to be understood that the remotely resettable target system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the remotely resettable target system.

It is therefore important that the claims be regarded as including such equivalent construction insofar as they do not depart from the spirit and scope of the remotely resettable target system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
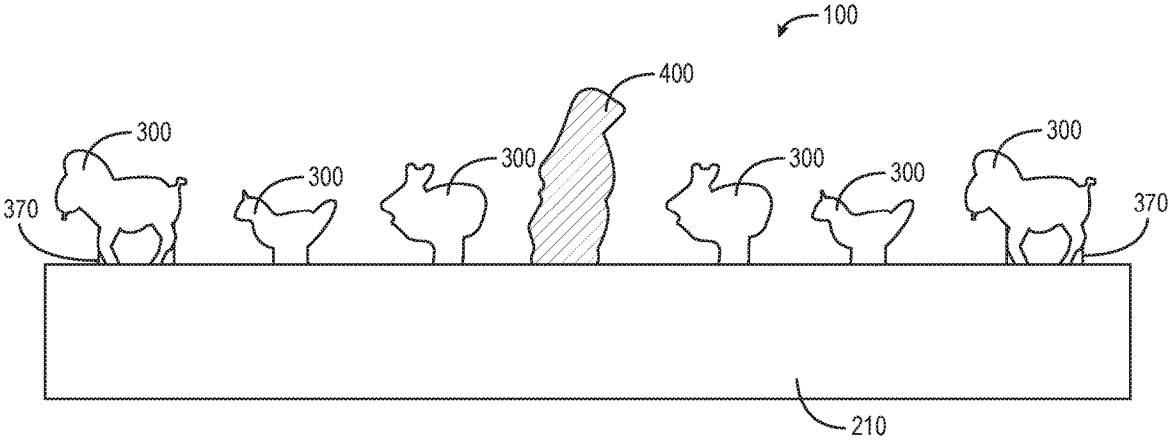
FIG. 1 is a front view of an embodiment of the disclosure.
Figure 2:
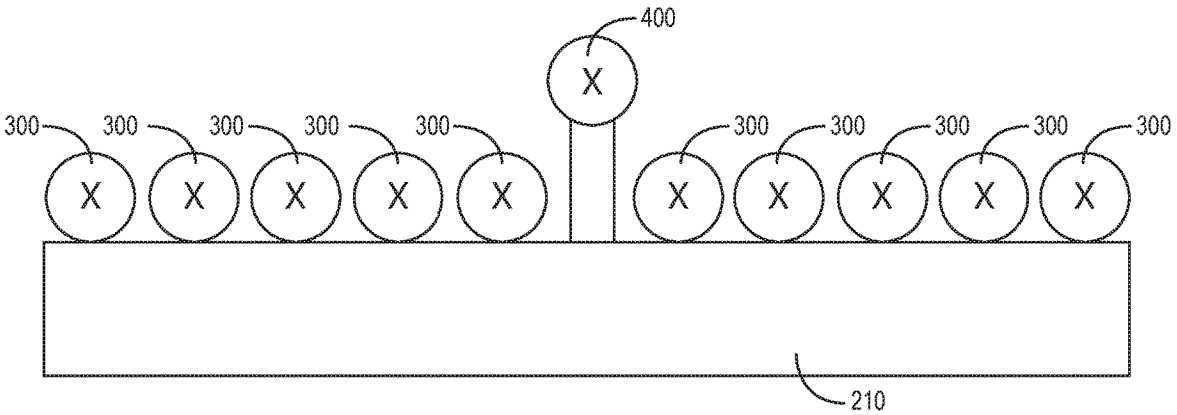
FIG. 2 is a front view of an alternative embodiment of the disclosure.
Figure 3:
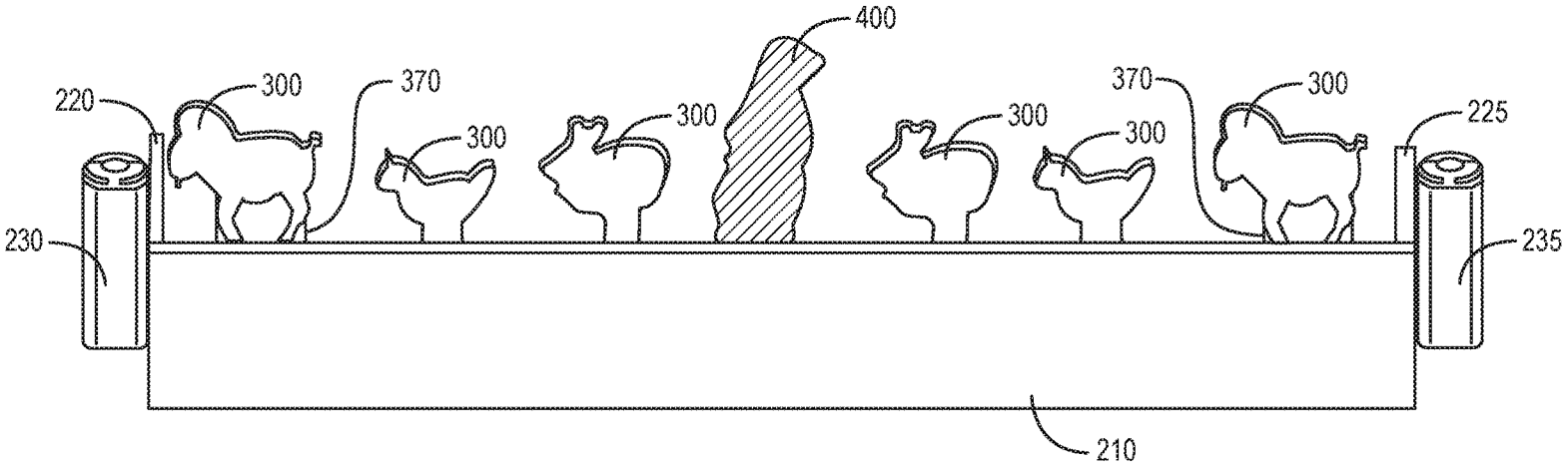
FIG. 3 is a perspective view of an embodiment of the disclosure.
Figure 4:
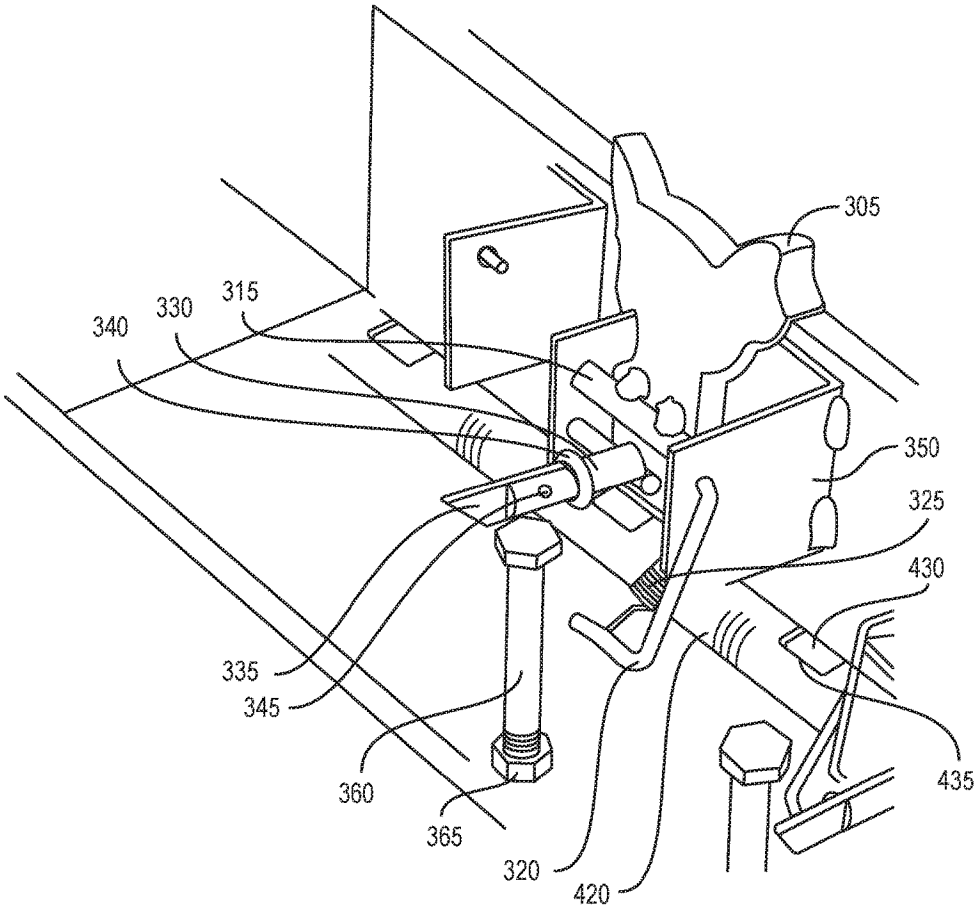
FIG. 4 is a detail view of an embodiment of the disclosure illustrating a non-resetting target in a vertical position.
Figure 5:
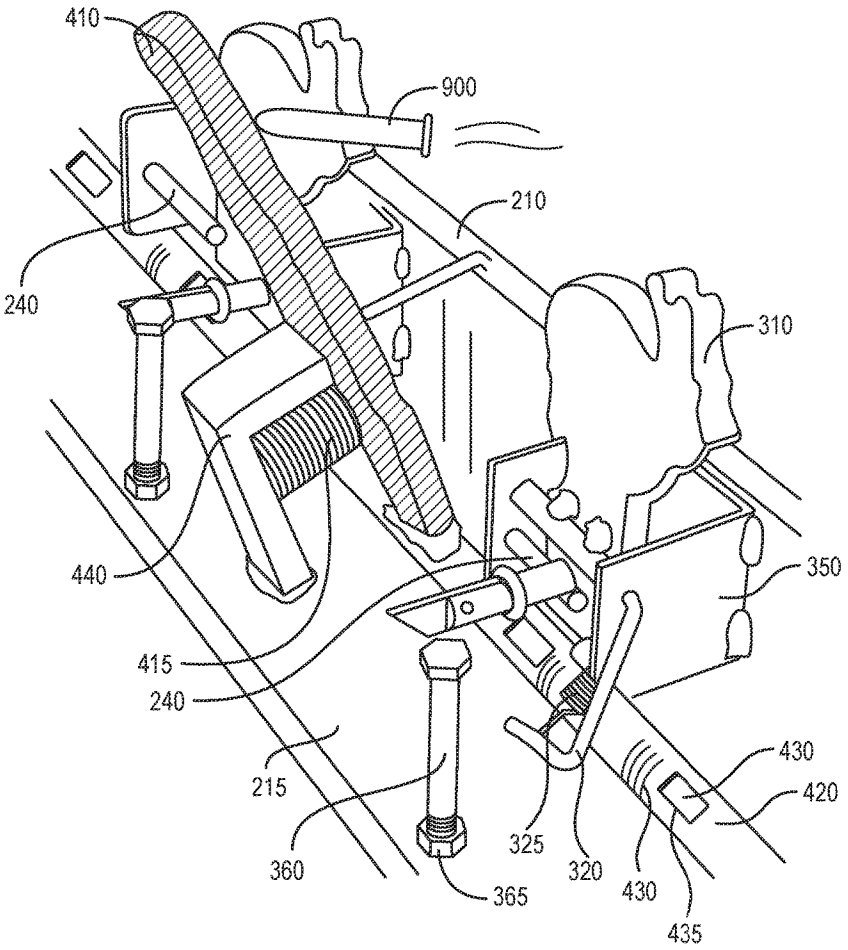
FIG. 5 is a detail view of an embodiment of the disclosure illustrating the resetting target in the non-vertical position and non-resetting targets in the vertical position.
Figure 6:
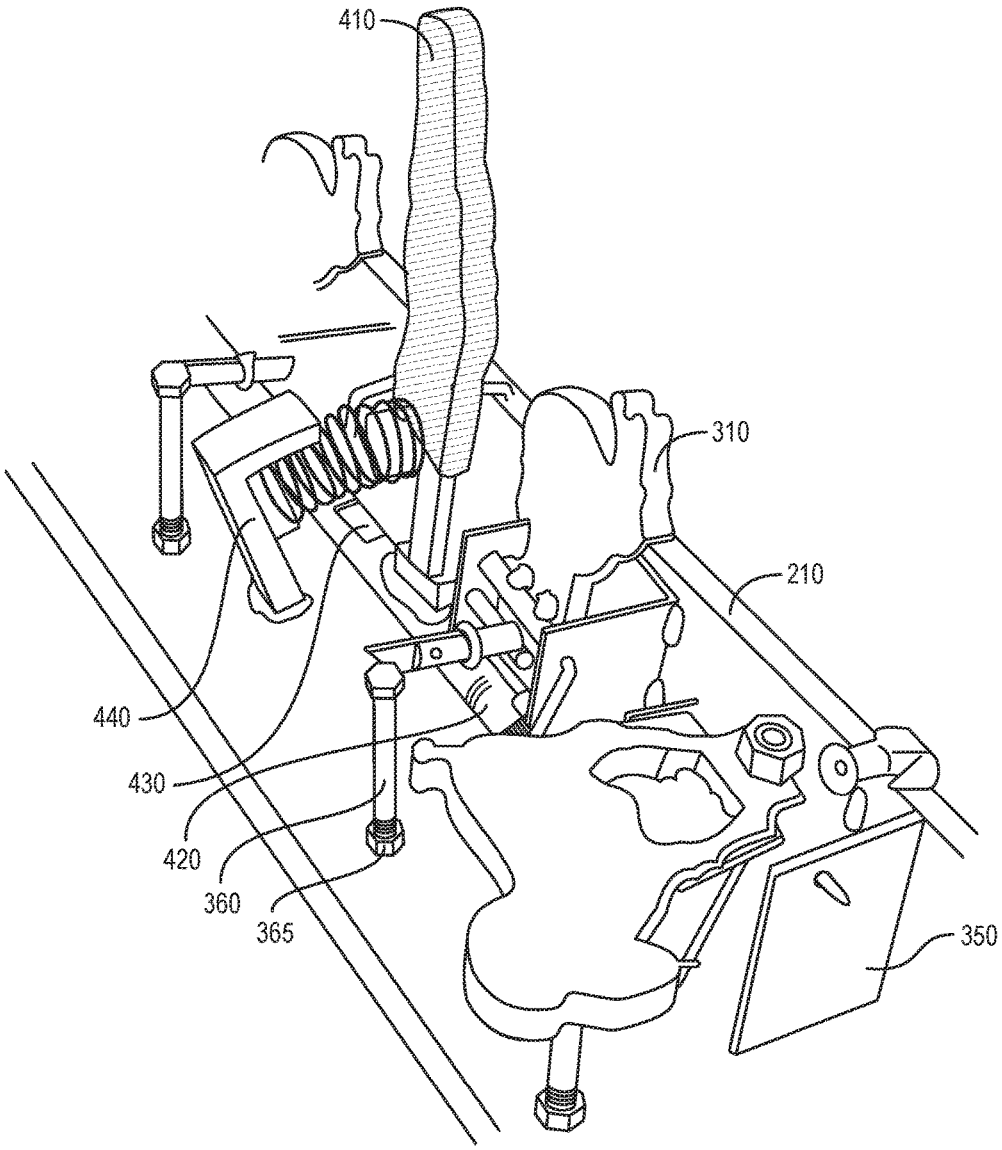
FIG. 6 is a detail view of an embodiment of the disclosure illustrating the resetting target in the vertical position and one of the non-resetting targets in the horizontal position.
Figure 7:
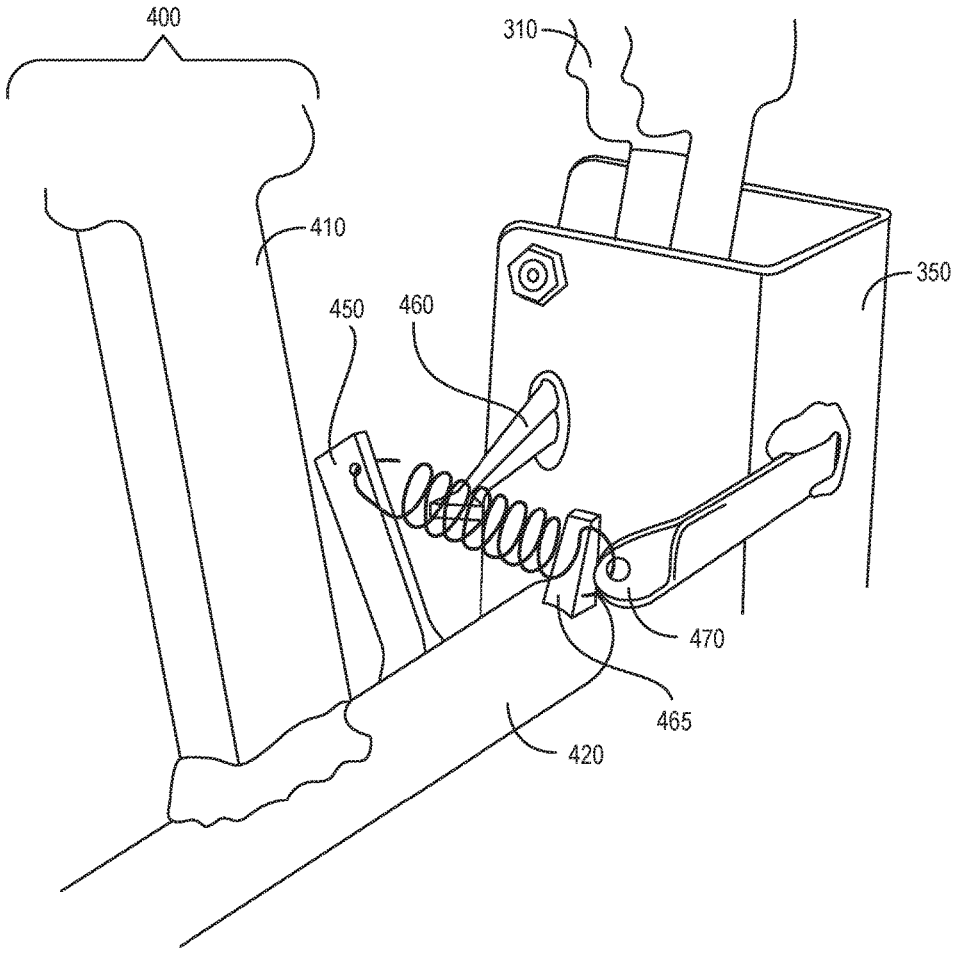
FIG. 7 is a detail view of an embodiment of the disclosure illustrating an alternative embodiment of the resetting target return spring and resetting target back stop.

Detailed reference will now be made to a first potential embodiment of the disclosure, which is illustrated in FIGS. 1 through 7.

The remotely resettable target system 100 (hereinafter invention) comprises one or more non-resetting targets 300, a resetting target 400, and a frame. The invention 100 is a set of practice targets for use when shooting a firearm (not illustrated in the figures). The one or more non-resetting targets 300 and the resetting target 400 start in a vertical position where they are visible from uprange. When struck by a fired round 900, the one or more non-resetting targets 300 pivot to a horizontal position and disappear from sight.

When struck by the fired round 900, the resetting target 400 pivots to a non-vertical position and then returns to the vertical position. While in the non-vertical position, the resetting target 400 releases the one or more non-resetting targets 300, causing the one or more non-resetting targets 300 to pivot back to the vertical position.

The one or more non-resetting targets 300 comprises a pivot paddle, a target mount, and a locking hammer. The one or more non-resetting targets 300 may pivot to the horizontal position and lock into place when struck by the fired round 900. The one or more non-resetting targets 300 may remain in the horizontal position until the resetting target 400 is struck by the fired round 900.

The pivot paddle comprises a non-resetting target paddle 310 and a pivot rod 315. The non-resetting target paddle 310 may be a metal plate that is coupled to the pivot rod 315 such that the non-resetting target paddle 310 extends both above and below the pivot rod 315. The portion of the non-resetting target paddle 310 that is located above the pivot rod 315 may be shaped and marked to form a target. As non-limiting examples, the shape of the non-resetting target paddle 310 may be a geometric figure such as a circle or the shape of an animal and the marking may be a solid color, a realistic representation of an animal, or a bullseye pattern applied to the front surface of the non-resetting target paddle 310.

The left and right ends of the pivot rod 315 may be rotationally coupled to a target support bracket 350 such that the non-resetting target paddle 310 may pivot between the vertical position and the horizontal position. As a non-limiting example, the pivot rod 315 may be a threaded rod or tube that passes through apertures in the sides of the target support bracket 350 and is held in place by a nut on each side.

The target mount comprises the target support bracket 350, a spring arm 320, and a non-resetting target return spring 325. The target support bracket 350 may be a U-shaped metal plate for mounting an individual non-resetting target 305. The target support bracket 350 may be mounted to a front plate 210 of the frame such that the center of the U is coupled to the front plate 210 and the sides of the U extend towards the rear of the invention 100. The target support bracket 350 may be oriented such that the U-shape is apparent when viewed from above. The ends of the pivot rod 315 may be rotationally coupled to the sides of the target support bracket 350 such that the pivot rod 315 runs horizontally from left to right within the target support bracket 350.

The spring arm 320 may be an armature that couples at a first arm end to the outside of the target support bracket 350. A second arm end may form a hook or right angle bend that is suspended behind the target support bracket 350.

The non-resetting target return spring 325 may be coupled between the spring arm 320 and the non-resetting target paddle 310. Specifically, a first non-resetting spring end may be coupled to the second arm end of the spring arm 320 and a second non-resetting spring end may be coupled to the bottom half of the non-resetting target paddle 310. The non-resetting target return spring 325 may cause the non-resetting target paddle 310 to pivot from the horizontal position to the vertical position except when the non-resetting target paddle 310 is prohibited from doing so by the locking hammer.

The locking hammer comprises a lock shaft 330, a locking lever 335, a locking lever pivot pin 345, and an O-ring 340. The locking hammer may lock the non-resetting target paddle 310 in the horizontal position by engaging the locking lever 335 with one of a plurality of milled cuts 430 located on a reset shaft 420 of the resetting target 400.

The lock shaft 330 may be a shaft that is coupled at a front end to the bottom half of the non-resetting target paddle 310. The lock shaft 330 may extend towards the rear of the invention 100 when the non-resetting target paddle 310 is in the vertical position. The rear end of the lock shaft 330 may be notched to accept the locking lever 335. The notch may be vertically oriented.

The locking lever 335 may be a metal bar that is narrower than the width of the notch on the rear end of the lock shaft 330. The height of the locking lever 335 from top to bottom may match the diameter of the lock shaft 330. The locking lever 335 may be pivotably coupled to the lock shaft 330 via the locking lever pivot pin 345. The locking lever pivot pin 345 may pass through the lock shaft 330 and the locking lever 335 in a horizontal direction. The locking lever 335 may extend rearward from the lock shaft 330. The rear end of the locking lever 335 may be angled such that the top edge of the locking lever 335 extends farther to the rear than the bottom edge of the locking lever 335 does.

The O-ring 340 may surround the lock shaft 330 between the non-resetting target paddle 310 and the locking lever pivot pin 345 such that the O-ring 340 also touches an edge of the locking lever 335. The O-ring 340 may hold the locking lever 335 in a position where the locking lever 335 is aligned with the lock shaft 330 except when the locking lever 335 is acted upon by a force applied to the angled end of the locking lever 335. The overall length of the lock shaft 330 and the locking lever 335 may be such that when one or the one or more non-resetting targets 300 pivots to the horizontal position the longest edge of the locking lever 335 reaches to the reset shaft 420 at the position of one of the plurality of milled cuts 430.

When the one or more non-resetting targets 300 pivot from the vertical position to the horizontal position, the shorter edge of the locking lever 335 may press against the reset shaft 420 and may cause the locking lever 335 to pivot within the lock shaft 330, allowing the locking lever 335 to slide over a locking lip 435 of one of the plurality of milled cuts 430. Once past the locking lip 435, the O-ring 340 may cause the locking lever 335 to straighten. As the non-resetting target return spring 325 attempts to pull the non-resetting target paddle 310 back to the vertical position, the longer edge of the locking lever 335 may be pressed against the locking lip 435 and may be prevented from moving by the locking lip 435.

The resetting target 400 comprises a resetting target paddle 410, the reset shaft 420, and a resetting target return spring 415. The resetting target paddle 410 may be a metal plate that is coupled to the reset shaft 420 at the bottom edge of the resetting target paddle 410. The resetting target paddle 410 may be shaped and marked to form a target. As non-limiting examples, the shape of the resetting target paddle 410 may be a geometric figure such as a circle or the shape of an animal and the marking may be a solid color, a realistic representation of an animal, or a bullseye pattern applied to the front surface of the resetting target paddle 410. The resetting target paddle 410 may be visually distinguishable from the non-resetting target paddles 310 by being a different size, shape, location, height, marking, or a combination thereof.

The left and right ends of the reset shaft 420 may be rotationally coupled to a left side 220 of the frame and to a right side 225 of the frame such that the resetting target paddle 410 may pivot between the vertical position and the non-vertical position.

The reset shaft 420 may comprise the plurality of milled cuts 430. There may be one of the plurality of milled cuts 430 for each of the one or more non-resetting targets 300. Each of the plurality of milled cuts 430 may have one of the locking lips 435. The plurality of milled cuts 430 may be located on the top of the reset shaft 420 at a lateral position along the reset shaft 420 that lies directly below the locking hammer of the one or more non-resetting targets 300 associated with each of the plurality of milled cuts 430.

The resetting target return spring 415 may push or pull the resetting target 400 into the vertical position each time it is struck by the fired round 900. The resetting target return spring 415 may be coupled between the lower half of the resetting target paddle 410 and the bottom portion of a resetting target back stop 440 or between a spring extension 450 of the reset shaft 420 and a front spring retainer 470 in front of the resetting target 400.

The frame comprises the front plate 210, a bottom plate 215, the left side 220, the right side 225, a non-resetting target back stop 360, the resetting target back stop 440, a left mounting sleeve 230, and a right mounting sleeve 235. The left edge of the front plate 210 may be coupled to the front edge of the left side 220. The right edge of the front plate 210 may be coupled to the front edge of the right side 225. The bottom edge of the front plate 210 may be coupled to the front edge of the bottom plate 215. The bottom edge of the left side 220 may be coupled to the left edge of the bottom plate 215. The bottom edge of the right side 225 may be coupled to the right edge of the bottom plate 215. In some embodiments, the front plate 210 and the bottom plate 215 may be a single, L-shaped component.

The invention 100 may further comprises a plurality of vertical stops 240. The plurality of vertical stops 240 may be bolts, rods, or armatures that stop the forward motion of the resetting target 400 and stop the forward motion of the one or more non-resetting targets 300 in the vertical position when the resetting target 400 and the one or more non-resetting targets 300 are pushed forward. The plurality of vertical stops 240 may extend into a position in front of the top half of the one or more non-resetting targets 300, behind the bottom half of the one or more non-resetting targets 300, or a combination thereof. At least one of the plurality of vertical stops 240 may extend into a position in front of the resetting target 400. The plurality of vertical stops 240 may be coupled to the front plate 210, to a side wall of the target support bracket 350, or a combination thereof.

The non-resetting target back stop 360 may prevent the one or more non-resetting targets 300 from moving past the horizontal position when they are struck by the fired round 900. Each of the non-resetting target back stops 360 may be coupled to the bottom plate 215 behind each of the one or more non-resetting targets 300. In some embodiments, the non-resetting target back stops 360 may be bolts with height adjustment lock nuts 365 that screw into threaded holes in the bottom plate 215 so that the height of the non-resetting target back stops 360 may be adjusted. The height adjustment lock nuts 365 may be tightened against the bottom plate 215 to prevent movement of the bolts once the height is correct. If the height of the non-resetting target back stop 360 is too high, the one or more non-resetting targets 300 may be stopped before pivoting to an angle where the locking lever 335 may engage and lock the one or more non-resetting targets 300 in the horizontal position.

The resetting target back stop 440 may limit the rearward motion of the resetting target 400 when it is struck by the fired round 900. The resetting target back stop 440 may be coupled to the bottom plate 215 at a position behind the resetting target 400. In some embodiments, the resetting target back stop 440 may be an L-shaped armature with a bottom end of the L coupled to the bottom plate 215 and a top end of the L pointing towards the resetting target 400 and positioned to stop the rearward motion of the resetting target 400 when it reaches the non-vertical position. In some embodiments, the resetting target back stop may be a back stop arm 460 extending from the target support bracket 350 adjacent to the resetting target 400 and a back stop extension 465 of the reset shaft 420 arranged to limit rotation of the reset shaft 420. Since there is no locking mechanism on the resetting target 400, once the resetting target 400 hits the resetting target back stop 440 it may be pushed forward to the vertical position by the resetting target return spring 415.

In some embodiments, at least one of the one or more non-resetting targets 300 may comprise a deflection shield 370. The deflection shield 370 may be a metal plate positioned to deflect the fired round 900 away from the invention 100 in order to prevent damage.

In use, the invention 100 is positioned downrange and staked to the ground using the left mounting sleeve 230 and the right mounting sleeve 235. Shots are fired at the one or more non-resetting targets 300 first. Each time one of the one or more non-resetting targets 300 is struck it pivots rearward and locks into place in the horizontal position, effectively disappearing from view. When the resetting target 400 is struck, it pivots rearward causing the one or more non-resetting targets 300 to be released and then the resetting target 400 and the one or more non-resetting targets 300 return to the vertical position and may be shot at again.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used herein, the words "couple", "couples", "coupled" or "coupling", refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, a "firearm" is a handheld weapon designed to expel a projectile which has been accelerated using a mechanism comprising an explosion.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "lateral" refers to the sides of an object or movement towards a side. Lateral directions are generally perpendicular to longitudinal directions. "Laterally" refers to movement in a lateral direction.

As used in this disclosure, a "notch" is an indentation formed in an edge or a cavity or aperture formed within a surface.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used in this disclosure, a "plate" is a flat, rigid object having at least one dimension that is of uniform thickness and is thinner than the other dimensions of the object. Plates often have a rectangular or disk like appearance. Plates may be made of any material, but are commonly made of metal.

As used herein, the words "printed" or "marked" refer to a mark that has been made on an object. The process of making the mark may involve printing, lithography, thermal transfer, painting, burning, silk-screening, drawing, stamping, spraying of pigments, or other processes which result in the controlled change of coloration of a surface.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A remotely resettable target system comprising:

one or more non-resetting targets, a resetting target, and a frame;

wherein the remotely resettable target system is a set of practice targets for use when shooting a firearm;

wherein the one or more non-resetting targets and the resetting target start in a vertical position where they are visible from uprange;

wherein when struck by a fired round, the one or more non-resetting targets pivot to a horizontal position and disappear from sight;

wherein when struck by the fired round, the resetting target pivots to a non-vertical position and then returns to the vertical position;

wherein while in the non-vertical position, the resetting target releases the one or more non-resetting targets, causing the one or more non-resetting targets to pivot back to the vertical position;

wherein the one or more non-resetting targets comprises a pivot paddle, a target mount, and a locking hammer;

wherein the one or more non-resetting targets pivot to the horizontal position and lock into place when struck by the fired round;

wherein the one or more non-resetting targets remain in the horizontal position until the resetting target is struck by the fired round;

wherein the pivot paddle comprises a non-resetting target paddle and a pivot rod;

wherein the non-resetting target paddle is a metal plate that is coupled to the pivot rod such that the non-resetting target paddle extends both above and below the pivot rod;

wherein the portion, of the non-resetting target paddle that is located above the pivot rod is shaped and marked to form a target;

wherein the left and right ends of the pivot rod are rotationally coupled to a target support bracket such that the non-resetting target paddle pivots between the vertical position and the horizontal position.

2. The remotely resettable target system according to claim 1 wherein the target mount comprises the target support bracket, a spring arm, and a non-resetting target return spring;

wherein the target support bracket is a U-shaped metal plate for mounting an individual non-resetting target;

wherein the target support bracket is mounted to a front plate of the frame such that the center of the U is coupled to the front plate and the sides of the U extend towards the rear of the remotely resettable target system;

wherein the target support bracket is oriented such that the U-shape is apparent when viewed from above;

wherein the ends of the pivot rod are rotationally coupled to the sides of the target support bracket such that the pivot rod runs horizontally from left to right within the target support bracket;

wherein the spring arm is an armature that couples at a first arm end to the outside of the target support bracket;

wherein a second arm end forms a hook or right angle bend that is suspended behind the target support bracket.

3. The remotely resettable target system according to claim 2 wherein the non-resetting target return spring is coupled between the spring arm and the non-resetting target paddle;

wherein a first non-resetting spring end is coupled to the second arm end of the spring arm and a second non-resetting spring end is coupled to the bottom half of the non-resetting target paddle;

wherein the non-resetting target return spring causes the non-resetting target paddle to pivot from the horizontal position to the vertical position except when the non-resetting target paddle is prohibited from doing so by the locking hammer.

4. The remotely resettable target system according to claim 3 wherein the locking hammer comprises a lock shaft, a locking lever, a locking lever pivot pin, and an O-ring;

wherein the locking hammer locks the non-resetting target paddle in the horizontal position by engaging the locking lever with one of a plurality of milled cuts located on a reset shaft of the resetting target.

5. The remotely resettable target system according to claim 4 wherein the lock shaft is a shaft that is coupled at a front end to the bottom half of the non-resetting target paddle;

wherein the lock shaft extends towards the rear of the remotely resettable target system when the non-resetting target paddle is in the vertical position;

wherein the rear end of the lock shaft is notched to accept the locking lever;

wherein the notch is vertically oriented.

6. The remotely resettable target system according to claim 5 wherein the locking lever is a metal bar that is narrower than the width of the notch on the rear end of the lock shaft;

wherein the height of the locking lever from top to bottom matches the diameter of the lock shaft;

wherein the locking lever is pivotably coupled to the lock shaft via the locking lever pivot pin;

wherein the locking lever pivot pin passes through the lock shaft and the locking lever in a horizontal direction;

wherein the locking lever extends rearward from the lock shaft;

wherein the rear end of the locking lever is angled such that the top edge of the locking lever extends farther to the rear than the bottom edge of the locking lever does.

7. The remotely resettable target system according to claim 6 wherein the O-ring surrounds the lock shaft between the non-resetting target paddle and the locking lever pivot pin such that the O-ring also touches an edge of the locking lever;

wherein the O-ring holds the locking lever in a position where the locking lever is aligned with the lock shaft except when the locking lever is acted upon by a force applied to the angled end of the locking lever;

wherein the overall length of the lock shaft and the locking lever are such that when one or the one or more non-resetting targets pivots to the horizontal position the longest edge of the locking lever reaches to the reset shaft at the position of one of the plurality of milled cuts.

8. The remotely resettable target system according to claim 7 wherein when the one or more non-resetting targets pivot from the vertical position to the horizontal position, the shorter edge of the locking lever presses against the reset shaft and causes the locking lever to pivot within the lock shaft, allowing the locking lever to slide over a locking lip of one of the plurality of milled cuts;

wherein once past the locking lip, the O-ring causes the locking lever to straighten;

wherein as the non-resetting target return spring attempts to pull the non-resetting target paddle back to the vertical position, the longer edge of the locking lever is pressed against the locking lip and is prevented from moving by the locking lip.

9. The remotely resettable target system according to claim 8 wherein the resetting target comprises a resetting target paddle, the reset shaft, and a resetting target return spring;

wherein the resetting target paddle is a metal plate that is coupled to the reset shaft at the bottom edge of the resetting target paddle;

wherein the resetting target paddle is shaped and marked to form a target;

wherein the resetting target paddle is visually distinguishable from the non-resetting target paddles by being a different size, shape, location, height, marking, or a combination thereof.

10. The remotely resettable target system according to claim 9 wherein the left and right ends of the reset shaft are rotationally coupled to a left side of the frame and to a right side of the frame such that the resetting target paddle pivots between the vertical position and the non-vertical position.

11. The remotely resettable target system according to claim 10 wherein the reset shaft comprises the plurality of milled cuts;

wherein there is one of the plurality of milled cuts for each of the one or more non-resetting targets;

wherein each of the plurality of milled cuts comprises one of the locking lips;

wherein the plurality of milled cuts are located on the top of the reset shaft at a lateral position along the reset shaft that lies directly below the locking hammer of the one or more non-resetting targets associated with each of the plurality of milled cuts.

12. The remotely resettable target system according to claim 11 wherein the resetting target return spring pushes the resetting target into the vertical position each time it is struck by the fired round;

wherein the resetting target return spring is coupled between the lower half of the resetting target paddle and the bottom portion of a resetting target back stop or between a spring extension of the reset shaft and a front spring retainer in front of the resetting target.

13. The remotely resettable target system according to claim 12 wherein the frame comprises the front plate, a bottom plate, the left side, the right side, a non-resetting target back stop, a left mounting sleeve, and a right mounting sleeve;

wherein the left edge of the front plate is coupled to the front edge of the left side;

wherein the right edge of the front plate is coupled to the front edge of the right side;

wherein the bottom edge of the front plate is coupled to the front edge of the bottom plate;

wherein the bottom edge of the left side is coupled to the left edge of the bottom plate;

wherein the bottom edge of the right side is coupled to the right edge of the bottom plate.

14. The remotely resettable target system according to claim 13 wherein the front plate and the bottom plate are a single, L-shaped component.

15. The remotely resettable target system according to claim 13 wherein the remotely resettable target system comprises a plurality of vertical stops;

wherein the plurality of vertical stops are bolts, rods, or armatures that stop the forward motion of the resetting target and stop the forward motion of the one or more non-resetting targets in the vertical position when the resetting target and the one or more non-resetting targets are pushed forward;

wherein the plurality of vertical stops extend into a position in front of the top half of the one or more non-resetting targets, behind the bottom half of the one or more non-resetting targets, or a combination thereof;

wherein at least one of the plurality of vertical stops extends into a position in front of the resetting target;

wherein the plurality of vertical stops are coupled to the front plate, to a side wall of the target support bracket, or a combination thereof;

wherein the non-resetting target back stop prevents the one or more non-resetting targets from moving past the horizontal position when they are struck by the fired round;

wherein each of the non-resetting target back stops are coupled to the bottom plate behind each of the one or more non-resetting targets.

16. The remotely resettable target system according to claim 15 wherein the non-resetting target back stops are bolts with height adjustment lock nuts that screw into threaded holes in the bottom plate so that the height of the non-resetting target back stops are adjusted;

wherein the height adjustment lock nuts are tightened against the bottom plate to prevent movement of the bolts.

17. The remotely resettable target system according to claim 16 wherein the resetting target back stop limits the rearward motion of the resetting target when it is struck by the fired round.

18. The remotely resettable target system according to claim 8 wherein at least one of the one or more non-resetting targets comprises a deflection shield;

wherein the deflection shield is a metal plate positioned to deflect the fired round away from the remotely resettable target system in order to prevent damage.

* * * * *